US008689897B2

(12) United States Patent
May

(10) Patent No.: US 8,689,897 B2
(45) Date of Patent: Apr. 8, 2014

(54) TRACTOR BLADE ASSEMBLY

(75) Inventor: Michael P. May, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 12/972,448

(22) Filed: Dec. 18, 2010

(65) Prior Publication Data

US 2012/0152573 A1 Jun. 21, 2012

(51) Int. Cl.
*E02F 3/00* (2006.01)

(52) U.S. Cl.
USPC ..... 172/777; 37/281

(58) Field of Classification Search
USPC ..... 172/777, 701.1, 701.2, 701.3, 815; 37/281
See application file for complete search history.

(56) References Cited

U.S. PATENT DOCUMENTS

| | | | | |
|---|---|---|---|---|
| 523,134 | A | 7/1894 | Sullivan | |
| 1,406,325 | A * | 2/1922 | Anderson et al. | 172/701.1 |
| 3,039,209 | A * | 6/1962 | Cron et al. | 37/403 |
| 4,019,268 | A * | 4/1977 | Waterman | 37/219 |
| 4,073,077 | A * | 2/1978 | Essel et al. | 37/281 |
| 4,741,116 | A | 5/1988 | Engle et al. | |
| 5,819,444 | A | 10/1998 | Desmarais | |
| 5,890,546 | A * | 4/1999 | Kerpash, Sr. | 172/684.5 |
| 6,112,438 | A * | 9/2000 | Weagley | 37/270 |
| 6,298,585 | B1 | 10/2001 | Boulet | |
| 6,484,813 | B2 * | 11/2002 | Tapio et al. | 172/701.1 |
| 7,407,016 | B1 * | 8/2008 | Kvalo | 172/784 |
| 7,588,092 | B2 * | 9/2009 | Liebl | 172/817 |
| 7,793,738 | B2 * | 9/2010 | Frederick | 172/684.5 |

FOREIGN PATENT DOCUMENTS

| | | |
|---|---|---|
| JP | 59-179939 | 3/1983 |

* cited by examiner

*Primary Examiner* — Thomas B Will
*Assistant Examiner* — Joel F. Mitchell
(74) *Attorney, Agent, or Firm* — Miller, Matthias & Hull

(57) ABSTRACT

A tractor blade assembly is disclosed having a first blade member and one or more replaceable, supplemental blade members. The first blade member has a supplemental blade mounting section extending laterally beyond the side edge of the first blade member and a supplemental blade member that removably attaches to the supplemental blade mounting section such that a side edge of the supplemental blade member abuts the side edge of the first blade member. The tractor blade assembly may include alignment structure to restrict vertical movement of the supplemental blade member relative to the first blade member and align the side edges.

19 Claims, 7 Drawing Sheets

TRACTOR BLADE ASSEMBLY

TECHNICAL FIELD

The present disclosure relates generally to a blade for a tractor, and more particularly to a blade having a first blade member and one or more replaceable supplemental blade members.

BACKGROUND

Earth moving machines, such as track type tractors, are often used in the construction industry for moving large amounts of earth or other material. The earth moving machines may utilize a blade that is mounted onto the front of the machine to push the earth or other material. A variety of blade designs are available for different applications, such as straight blade or U-shaped blade.

Straight blades are typically constructed from a single, curved, steel moldboard while U-shaped blades or semi-U-shaped blades have a center moldboard and outer wings welded to the center moldboard and reinforced to provide support. Tractor blades, therefore, are manufactured in a single configuration. If a machine operator has a tractor with a straight blade, but the job is better suited for a U-shaped blade, the operator would need to either operate less efficiently with a straight blade or replace the entire straight blade with a U-shaped blade.

The present disclosure is directed toward one or more of the problems set forth above.

SUMMARY OF THE DISCLOSURE

In one aspect of the present disclosure, a tractor blade assembly includes a first blade member having a supplemental blade mounting section extending laterally beyond the side edge of the first blade member and a second blade member that removably attaches to the supplemental blade mounting section such that a side edge of the second blade member abuts the side edge of the first blade member. The tractor blade assembly may include alignment structure to restrict vertical movement of the second blade member relative to the first blade member and align the side edge.

In another aspect, a tractor blade includes a supplemental blade mounting section extending laterally beyond the side edge of the blade and configured to receive a supplemental blade member for fixable attachment thereto.

In another aspect, a supplemental blade member includes a rearward facing mounting surface configured to engage a forward facing mounting surface on a first blade member. The rearward facing mounting surface being position adjacent the back surface between a first side edge and a second side edge of the supplemental blade member.

DETAILED DESCRIPTION

Figure 1:
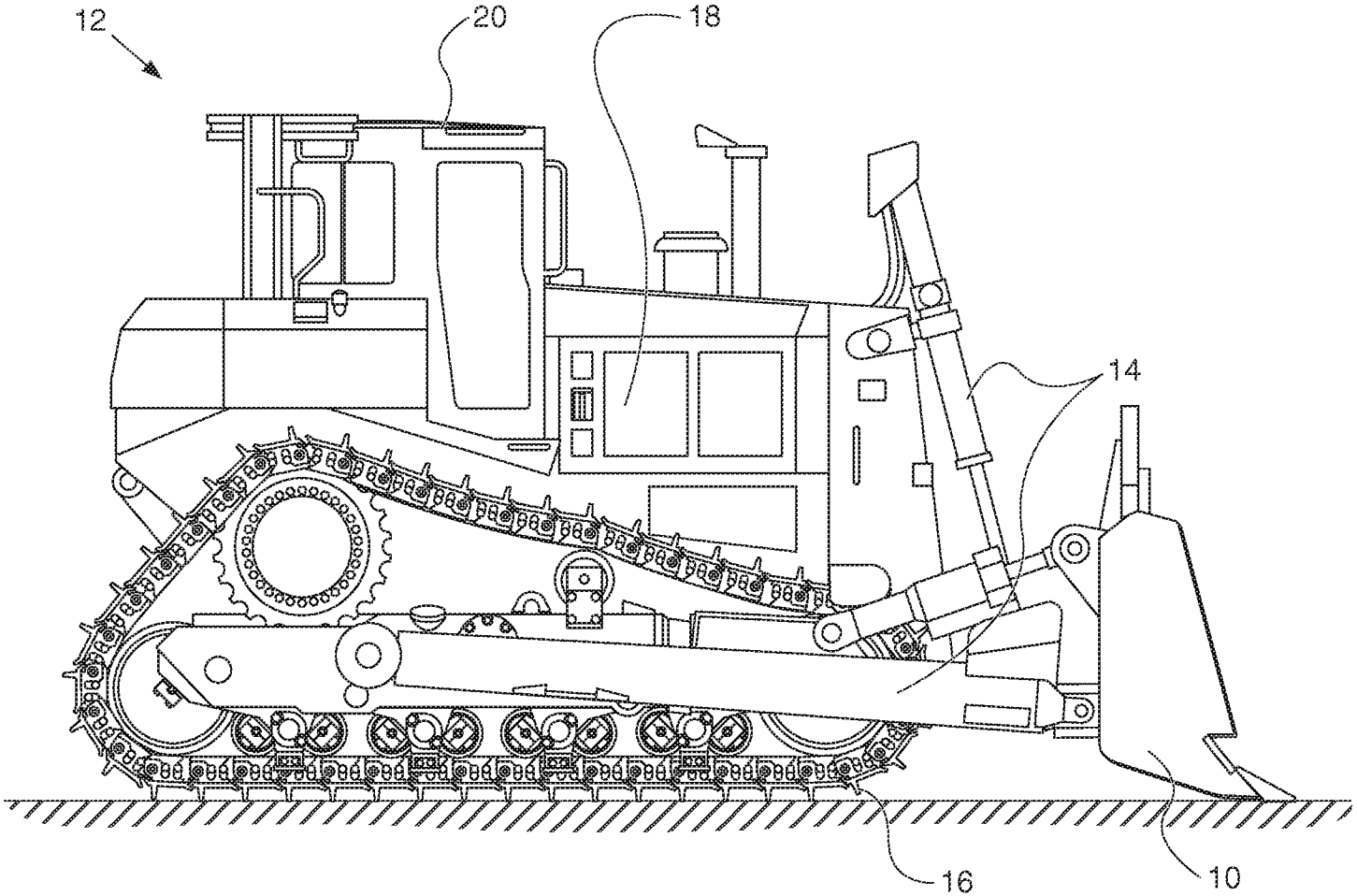
FIG. 1 is a perspective view of a tractor blade attached to a machine according to the present disclosure.

Referring to FIG. 1, a tractor blade 10 is attached to a machine 12. Machine 12 may embody a mobile machine that performs some type of operation associated with an industry such as mining, construction, farming, transportation, or any other industry known in the art. For example, machine 12 may be an earth moving machine such as a track-type tractor, a wheel dozer, or other suitable machine. Machine 12 may include an implement system 14 configured to adjust the positioned or orientation of the tractor blade 10, a drive system 16 for propelling the machine 12, a power source 18 that provides power to implement system 14 and drive system 16, and an operator station 20 for operator control of implement system 14 and drive system 16.

Power source 18 may embody an engine such as, for example, a diesel engine, a gasoline engine, a gaseous fuel-powered engine or any other type of combustion engine known in the art. It is contemplated that power source 18 may alternatively embody a non-combustion source of power such as a fuel cell, a power storage device, or another source known in the art. Power source 18 may produce a mechanical or electrical power output that may then be converted to hydraulic or pneumatic power for moving the implement system 14.

Implement system 14 may include a linkage structure acted on by fluid actuators to move the tractor blade 10. The linkage structure of implement system 14 may be complex, including multiple degrees of freedom. For example, the implement system 14 may be able to move the tractor blade 10 up and down, tilt the top of the blade relative to the bottom, raise one side of the blade relative to the other, and angle the blade by moving one side of the blade forward relative to the other side.

Figure 2:
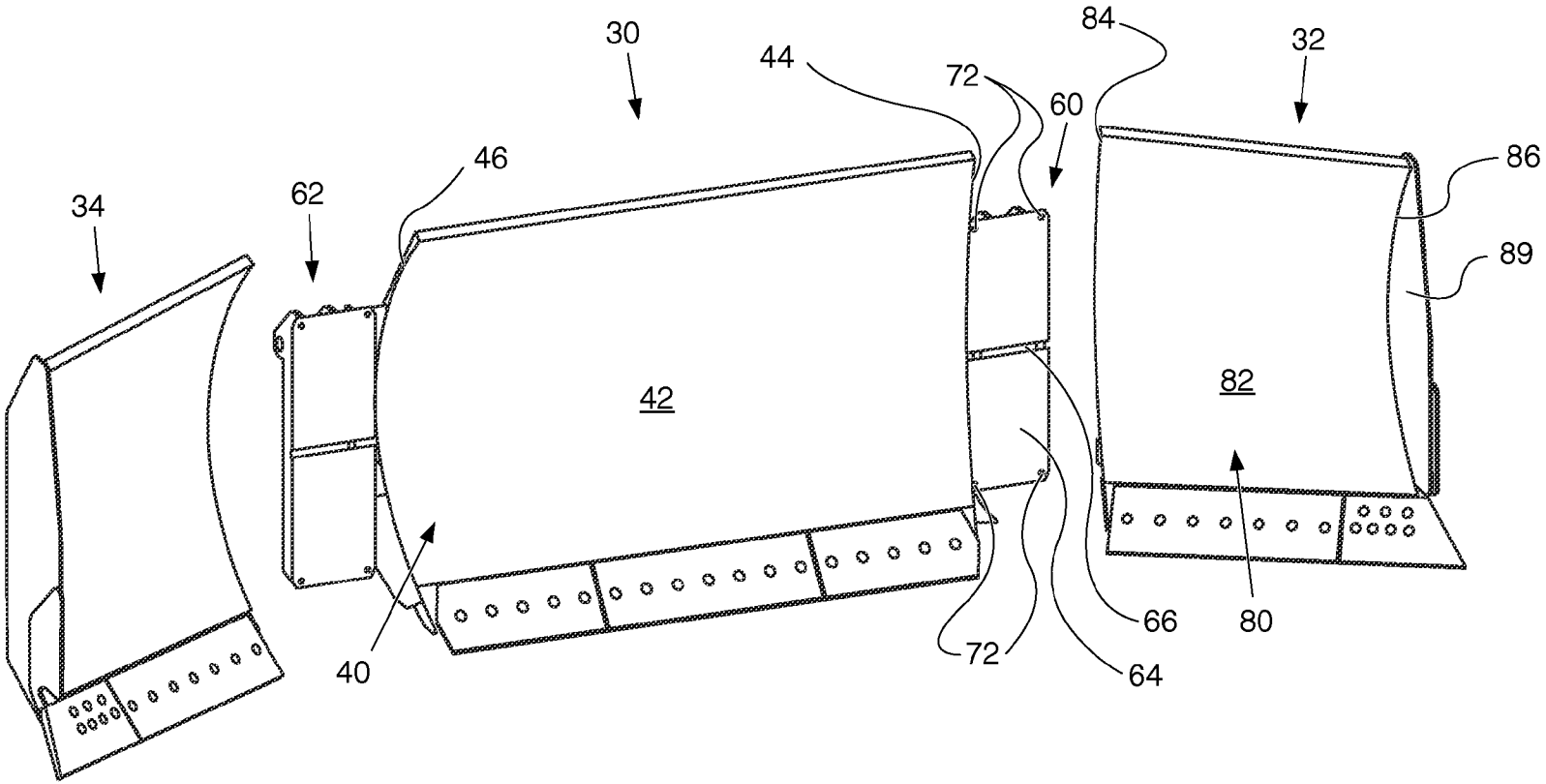
FIG. 2 is perspective view of an embodiment of the tractor blade of the present disclosure illustrating two supplemental blade members detached from a first blade member.

Referring to FIG. 2, a first embodiment of a tractor blade 10 is illustrated. Tractor blade 10 includes a first blade member 30, a second blade member 32, and a third blade member 34. The second blade member 32 and the third blade member 34 are configured to attach to the first blade member 30. The first blade member 30 is configured to be a universal section that is able to connect to attachable supplemental blade sections or wings. Thus, the tractor blade 10 can be assembled into multiple configurations by using different supplemental blade sections or wings with the universal section. In the depicted embodiment, the tractor blade 10 has a center section (i.e. the first blade member 30) and two similar supplemental blade sections (i.e. the second blade member 32 and the third blade member 34), each attached to either side of the center section to form a U-blade configuration.

Figure 3A:
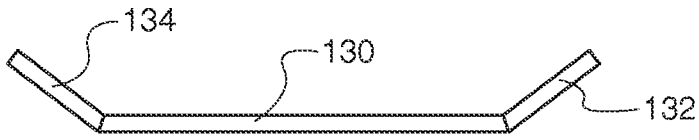
FIGS. 3A-3D are pictorial representations of top views of various embodiments of the tractor blade of the present disclosure.
Figure 3B:
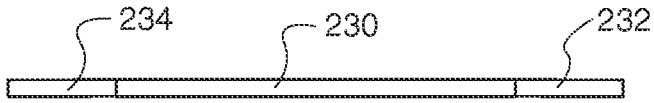
Figure 3C:
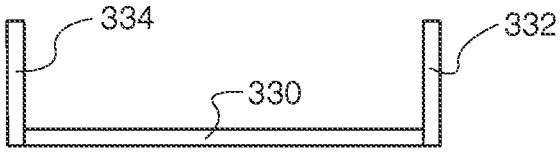
Figure 3D:
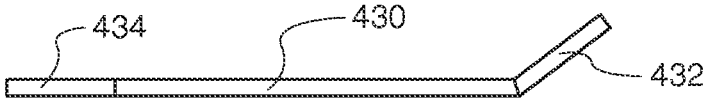

FIGS. 3A-3D illustrate, pictorially, some additional, but not all possible, configurations/embodiments of the tractor blade 10. FIG. 3A combines a first blade member 130 with a second blade member 132 and a third blade member 134 to form a semi-U blade configuration, which is similar to the U-blade configuration but the second and third blade members do not extend as far and may be at a different angle than the second and third blade members in the U-blade configuration. FIG. 3B combines a first blade member 230 with a second blade member 232 and a third blade member 234 to form a straight blade configuration. FIG. 3C combines a first blade member 330 with a second blade member 332 and a third blade member 334 to form a bowl blade configuration. FIG. 3D combines a first blade member 430 with a second blade member 432 and a third blade member 434 to form a hybrid blade configuration having an angled wing on one end and a straight wing on the other end. Such a configuration may be particularly useful with a power angle tilt arrangement on the machine 12.

The exemplary embodiments in FIGS. 2 and 3A-3B illustrate supplemental blade sections attached to either side of a center blade section. In other embodiments, however, the first blade member 30 may be configured to only attach to a single supplemental blade section on one side.

In the depicted embodiment in FIG. 2, the second blade member 32 attaches to the first blade member 30 in essentially the same manner as how the third blade member 34 attaches to the first blade member 30. Thus, only the attachment of the second blade member 32 to the first blade member 30 will be discussed in detail, since the description is equally applicable to the attachment of the third blade member 34 to the first blade member 30. In other embodiments, however, the second blade member 32 may attach to the first blade member 30 in a different manner than how the third blade member 34 attaches to the first blade member 30.

Figure 4:
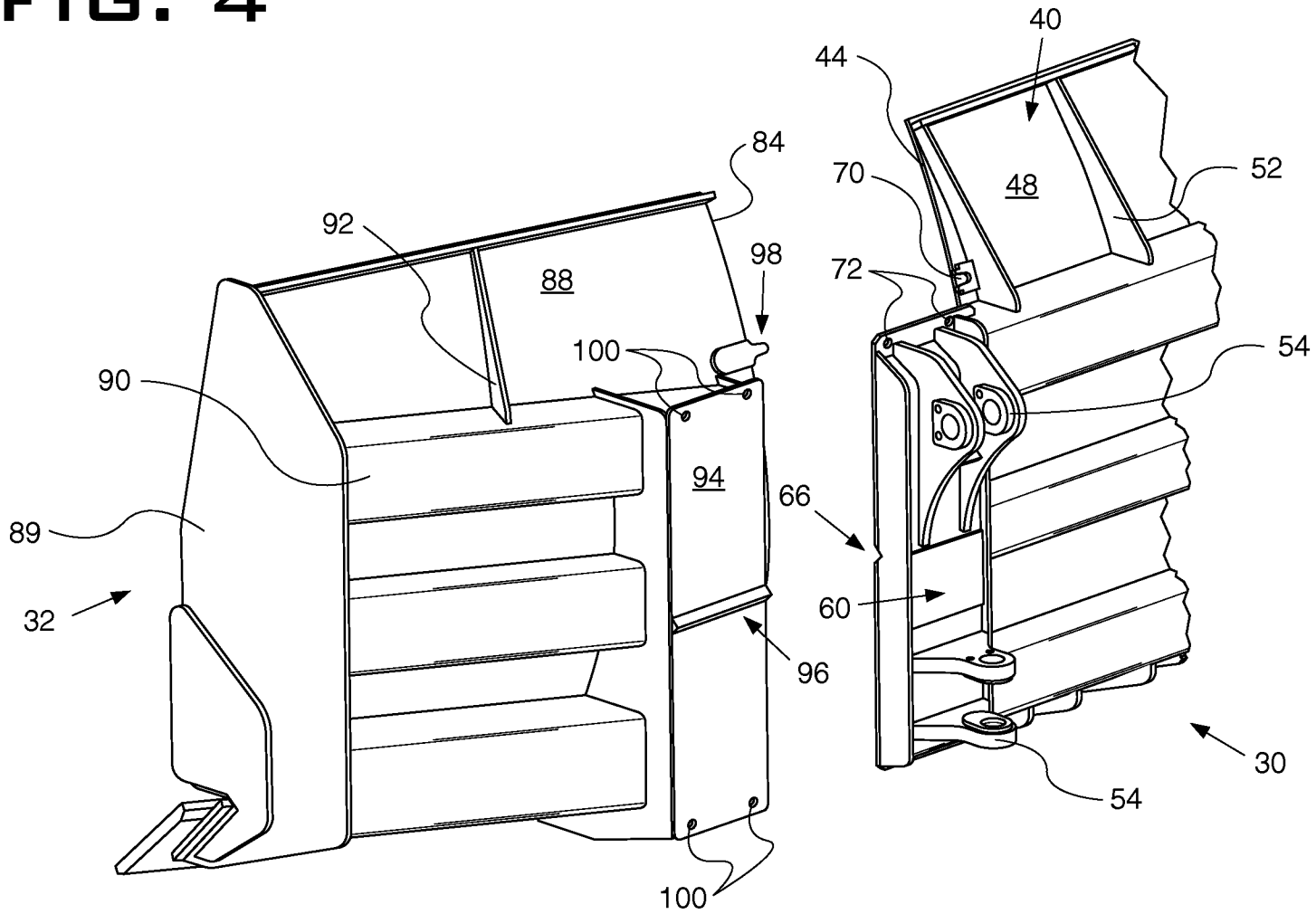
FIG. 4 is partial perspective view of the tractor blade of FIG. 2 illustrating a supplemental blade member attached to a first blade member.
Figure 5:
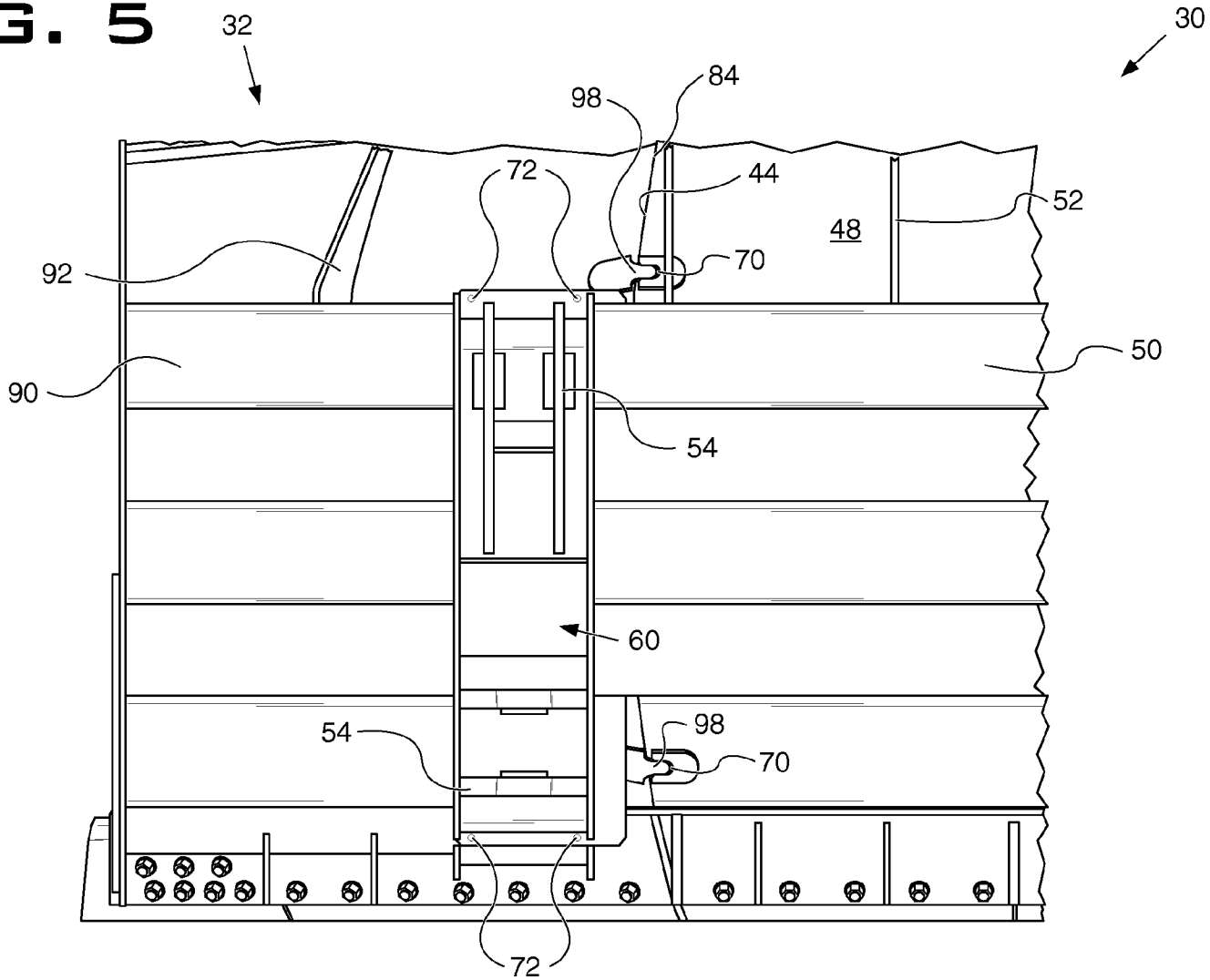
FIG. 5 partial rear view of the tractor blade of FIG. 2 illustrating a supplemental blade member attached to a first blade member.
Figure 6:
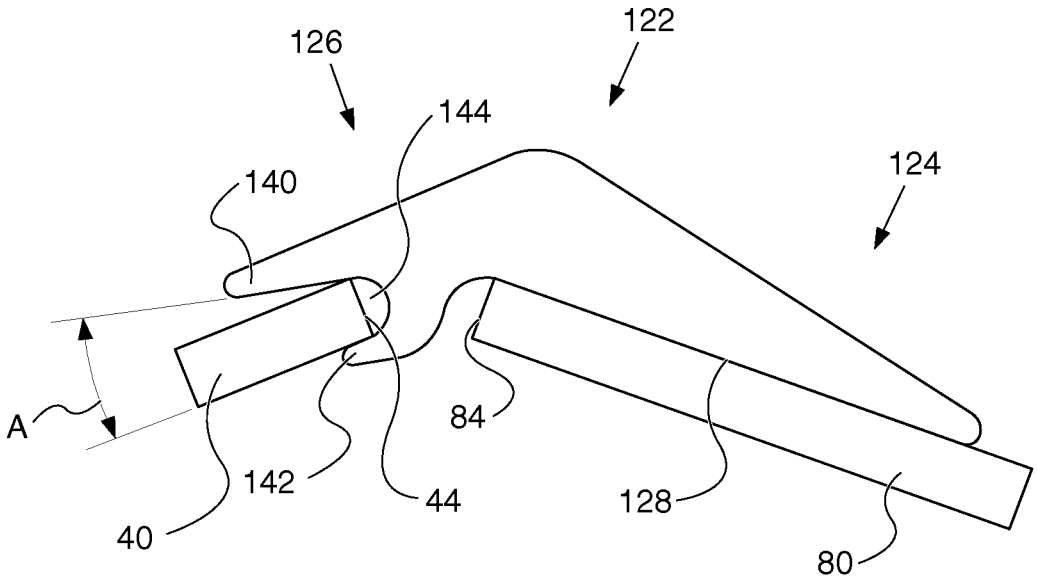
FIG. 6 is side view of an embodiment of an edge lock for the tractor blade of FIG. 2.
Figure 7:
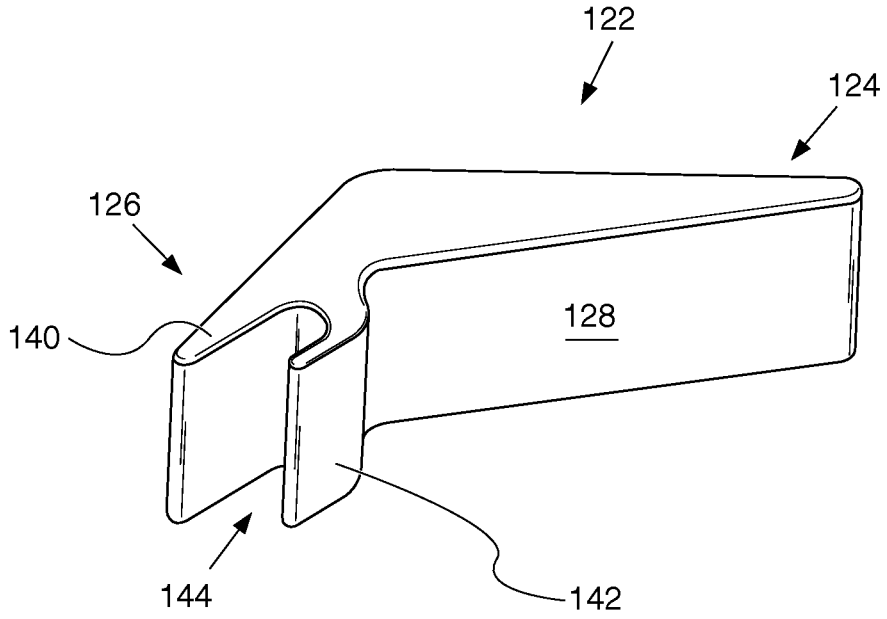
FIG. 7 is a perspective view of the edge lock of FIG. 6.
Figure 8:
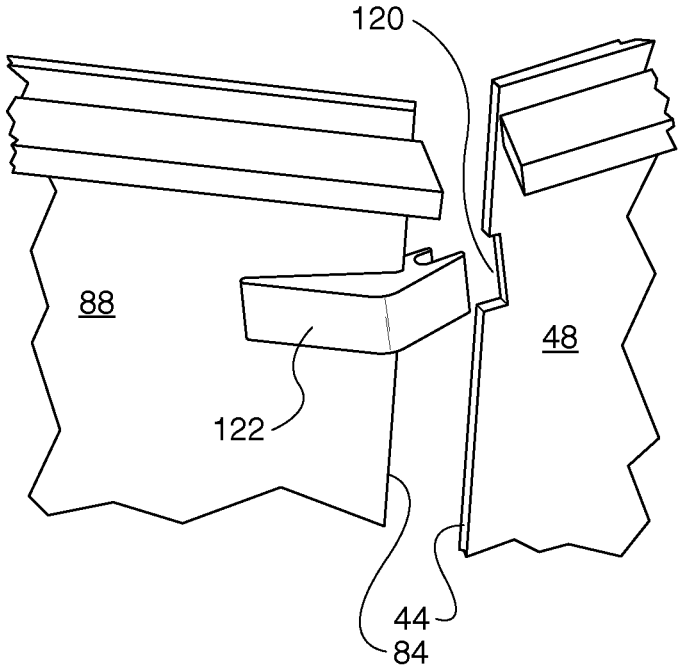
FIG. 8 is a partial perspective view of the edge lock of FIG. 6 on a supplemental blade member detached from a first blade member.
Figure 9:
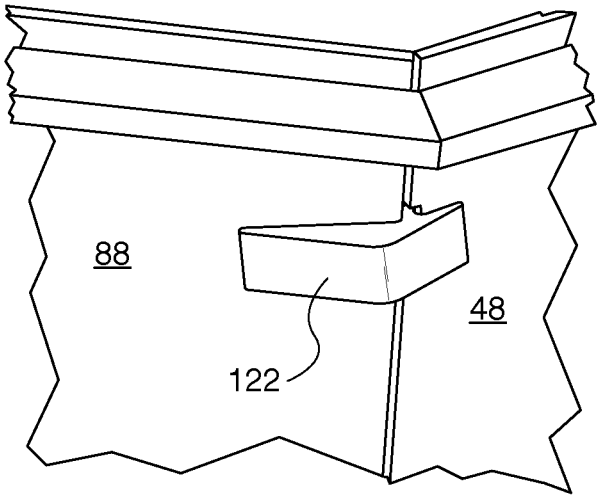
FIG. 9 is a partial perspective view of the edge lock of FIG. 6 on a supplemental blade member attached from a first blade member.

Referring to FIGS. 2, 4, and 5, in the depicted embodiment, the first blade member 30 includes a moldboard 40 having a curved front surface 42, a first side edge 44, a second side edge 46, and a curved back surface 48. The moldboard 40 may be, for example, a steel sheet rolled to form a curved surface. The moldboard 40 may be reinforced on the back surface to improve the strength of the first blade member 30. In the depicted embodiment, reinforcing structure on the first blade member 30 includes one or more rectangular tubes 50 extending along the length of the moldboard 40 and one or more ribs 52 extending along the curved back surface generally perpendicular to the one or more rectangular tubes 50. One or more machine mounting brackets 54 may be attached to the back surface 48 either directly or via the reinforcing structure, such as one or more of the rectangular tubes 50.

The first blade member 30 also includes a first supplemental blade mounting section 60 extending laterally beyond the first side edge 44 and a second supplemental blade mounting section 62 extending laterally beyond the second side edge 46. The first supplemental blade mounting section 60 includes a first mounting surface 64. In the depicted embodiment, the first mounting surface 64 is forward facing and generally planar with a height of approximately two-thirds the vertical height of the moldboard 40 and extends laterally approximately one-third the width of the moldboard 40. In other embodiments, the first mounting surface 64 may have a height in the range of approximately half the vertical height of the moldboard 40 to approximately the entire vertical height of the moldboard and extends laterally in the range of approximately one-quarter the width of the moldboard to approximately three-quarters the width of the moldboard. In another embodiment, the first mounting surface 64 extends laterally for approximately the entire width of the supplemental blade member.

The first mounting surface 64 may be a single, continuous surface or multiple, separated surfaces. In the depicted embodiment, the first mounting surface 64 is separated into two sections by a horizontal vee-groove 66. The vee-groove 66 serves as a first alignment structure configured to cooperate with corresponding structure on the second blade member 32 to restrict vertical movement of the first blade member 30 relative to the second blade member, as will be described in more detail below. The first alignment structure may be configured in a variety of ways. Any suitable structure capable of restricting or preventing unwanted vertical movement of the first blade member 30 relative to the second blade member 32 may be used. For example, in other embodiments more than one groove per side may be present, the groove may be other than vee-shaped, or the alignment structure may be configured as a ridge instead of a groove.

The first blade member 30 may also include a second alignment structure configured to cooperate with structure on the second blade member 32 to align, in abutting engagement, the first side edge 44 with a side edge of the second blade member 32. The second alignment structure may be configured in a variety of ways. Any suitable structure capable of aligning side edges of the first and second blade members may be used. In the depicted embodiment, the second alignment structure is configured as one or more grooves or recesses 70 for receiving a corresponding projection on the supplemental blade member. The grooves or recesses 70 may be formed integrally with the first blade member 30 or formed in or on a component attached to the first blade member. The depicted embodiment includes an upper and a lower recess 70 formed by a part that is attached to the curved back surface 48 of the moldboard. Other embodiments, however, may include more or less than two recesses 70 per side.

The first supplemental blade mounting section 60 may also include one or more fastener holes 72 for receiving fasteners, such as bolts. In the depicted embodiment, the first supplemental blade mounting section 60 includes two upper fastener holes and two lower fastener holes, though other embodiments may include more or less than four fasteners holes per side.

The second blade member 32 includes a moldboard 80 having a curved front surface 82, a first side edge 84, a second side edge 86, and a curved back surface 88. An edge guard 89 may be attached to the second side edge 86. As with moldboard 40, the moldboard 80 may be a steel sheet rolled to form a curved surface. The moldboard 80 may be reinforced on the back surface to improve the strength of the second blade member 32. In the depicted embodiment, reinforcing structure on the second blade member 32 includes one or more rectangular tubes 90 extending along the length of the moldboard 80 and one or more vertical ribs 92 extending from along the curved back surface generally perpendicular to the one or more rectangular tubes 90.

The second blade member 32 also includes a second mounting surface 94 that is generally planar, rearward facing, and configured to engage the first mounting surface 64 on the first blade member 30. In the depicted embodiment, the second mounting surface 94 is approximately the same size are the first mounting surface 64. In other embodiments, however, the size of the second mounting surface 94 may differ from the size of the first mounting surface 64.

The second mounting surface 94 may be a single, continuous surface or multiple, separated surfaces. In the depicted embodiment, the second mounting surface 94 is separated into two surfaces by a horizontal ridge 96. The ridge 96 acts as an alignment structure by cooperating with the groove 66 on the first blade member 30 to restrict vertical movement of the first blade member 30 relative to the second blade member 32. The alignment structure may be configured in a variety of ways. Any suitable structure capable of cooperating with the first alignment structure on the first blade member to restrict or prevent unwanted vertical movement of the first blade member 30 relative to the second blade member 32 may be used. For example, other embodiments may have more than one ridge or be configured as a groove to cooperate with a ridge on the first blade member 30.

The second blade member 32 also includes a second alignment structure configured to cooperate with the groove or recess 70 on the first blade member to align, in abutting engagement, the first side edge 84 with the first side edge 44 of the first blade member 30. The second alignment structure may be configured in a variety of ways. Any suitable structure capable of cooperating with the second alignment structure on the first blade member to align side edges of the first and second blade members may be used. In the depicted embodiment, the second alignment structure is configured as one or more projections 98 that closely fit in the one or more recesses on the first blade member 30. The projections 98 may be formed integrally with the second blade member 32 or formed by a component attached to the second blade member. The depicted embodiment includes an upper and a lower projection 98 attached to the curved back surface 88 of the moldboard. Other embodiments, however, may include more or less than two projections 98 per side. Furthermore, in other embodiments, the projections may be formed on the first blade member 30 and the groove or recess formed on the second blade member.

The second blade member 32 may also include one or more fastener holes 100 for receiving fasteners, such as bolts. In the depicted embodiment, the second blade member 32 includes two upper fastener holes and two lower fastener holes that correspond to and line up with the fastener holes 72 on the first blade member 30 in an assembled position. In other embodiments, the second blade member 32 may include more or less than four fasteners holes per side.

FIGS. 6-9 illustrates another embodiment of alignment structure configured to align, in abutting engagement, a side edge on the first blade member 30 with a side edge on the second blade member 32. The alignment structure includes a notch 120 on the first side edge 44 of the first blade member 30. An edge lock device 122 is attached to the back surface 88 or formed integrally with the second blade member 32. The edge lock 122 may be attached in any suitable manner, such as welding, adhesives, fasteners, or other suitable method. The edge lock 122 may be formed in a variety of ways. Any configuration capable of engaging the notched side edge of an adjacent moldboard to align the side edges may be used. In the depicted embodiment, the edge lock 122 includes a first portion 124 extending traverse to a second portion 126. The first portion 124 is tapered and includes a generally flat inner surface 128 configured to engage the back surface 88 of the second blade member 32.

When the edge lock 122 is attached to the second blade member 32, the second portion 126 extends beyond the first side edge 84. The second portion 126 includes a first finger 140 separated from a second finger 142 by a recess 144. The second portion 126 is configured such that the moldboard is wedged into the recess 144 while the first finger overlaps a portion of the back surface 48 and the second finger overlaps a portion of the front surface 42. The first finger 140 extends at an angle A relative from the second finger 142 to provide a lead-in for engaging the edge of the first blade member 30.

INDUSTRIAL APPLICABILITY

The tractor blade 10 may be used with a mobile machine, such as a track-type tractor, a wheel dozer, or other suitable machine, to push material, such as earth, coal, wood or metal chips, etc. The tractor blade 10 includes a first blade member and one or more supplemental blade members that can attach to the first blade member. As a result, the tractor blade 10 may be easily switched between different configurations. The operator need only have the supplemental blade members for the various configurations instead of entire blades for each configuration.

When properly mounted, the second mounting surface 94 on the second blade member 32 is seated against the first mounting surface 64 on the first blade member 30. Since many dozing applications place significant stress on the tractor blade 10, the first mounting surface 64 is configured with sufficient size and strength to provide a stable mounting structure for the second blade member 32 during these applications.

The ridge 96 is received in the groove 66 such that vertical movement of the second blade member 32 relative to the first blade member is restricted or prevented. In addition, the projection 98 is received in the recess 70 to align the first side edge 44 of the first blade member 30 with the first side edge 84 of the second blade member 32. In the embodiment of FIGS. 6-9, the second portion 126 of the edge lock 122 is received in the notch 120 and the moldboard is tightly received in the recess 144.

The fastener holes 72 on the first blade member 30 align with the fastener holes 100 on the second blade member 32. Fasteners (not shown), such as bolts, may be inserted through the fastener holes 72, 100 to clamp the second blade member 32 to the first blade member 30.

The third blade member 34 may attach to the other side of the first blade member 30 in a similar manner. Thus, the first blade member 30 acts as a center, universal blade member and the second and third blade members 32, 34 act as supplemental blade members that may be interchanged with other supplemental blade members with different configurations to change the configuration of the tractor blade 10.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A tractor blade adapted for use with a supplemental blade having a supplemental blade moldboard and a rearward facing mounting surface, the tractor blade comprising:

a tractor blade moldboard having a curved front surface, the tractor blade moldboard defining an overall vertical height and an overall lateral width extending from a first side edge of the tractor blade moldboard to a second side edge of the tractor blade moldboard;

a supplemental blade mounting section extending laterally beyond the first side edge of the tractor blade moldboard, the supplemental blade mounting section defining a forward facing mounting surface being configured to seatingly engage the rearward facing mounting surface of the supplemental blade across a forward facing mounting surface height of at least approximately one-half the overall vertical height of the tractor blade moldboard and across a forward facing mounting surface width of at least approximately one-quarter the overall lateral width of the tractor blade moldboard, wherein the supplemental blade mounting section is configured to hold the first side edge of the tractor moldboard in direct contact along the length of a side edge of a moldboard of a supplemental blade; and a machine mounting bracket disposed on a back surface of the tractor blade.

2. The tractor blade according to claim 1 wherein the forward facing mounting surface includes a laterally extending groove or laterally extending ridge.

3. The tractor blade according to claim 1 further comprising a first alignment structure configured to restrict vertical movement of the tractor blade relative to the rearward facing mounting surface of the supplemental blade.

4. The tractor blade according to claim 3 wherein the first alignment structure is a laterally extending groove or a laterally extending ridge.

5. The tractor blade according to claim 3 further comprising a second alignment structure configured to align in abutting engagement the first side edge of the tractor blade moldboard with a side edge of the supplemental blade moldboard wherein the second alignment structure is a laterally extending projection or a laterally facing recess.

6. The tractor blade assembly of claim 1, in which the machine mounting bracket is disposed on the supplemental blade mounting section opposite the forward facing mounting surface.

7. A supplemental blade for attachment to a tractor blade having a tractor blade moldboard defining an overall vertical height and an overall lateral width extending from a first side edge of the moldboard to a second side edge of the moldboard, the tractor blade further including forward facing mounting surface, the supplemental blade comprising:

a supplemental blade front surface;

a supplemental blade first side edge;

a supplemental blade second side edge;

a supplemental blade back surface; and the supplemental blade back surface defining a rearward facing mounting surface disposed between the supplemental blade first side edge and the supplemental blade second side edge, the rearward facing mounting surface configured to seatingly engage the forward facing mounting surface of the tractor blade across a forward facing mounting surface height of at least approximately one-half the overall vertical height of the tractor blade moldboard and across a forward facing mounting surface width of at least approximately one-quarter the overall lateral width of the tractor blade moldboard, wherein the supplemental blade mounting surface is configured to hold the first side edge of the tractor moldboard in direct contact along the length of the first side edge of the supplemental blade.

8. The supplemental blade according to claim 7 wherein the rearward facing mounting surface includes a laterally extending groove or laterally extending ridge.

9. The supplemental blade according to claim 7 further comprising a first alignment structure configured to restrict vertical movement of the supplemental blade relative to the tractor blade.

10. The supplemental blade according to claim 9 wherein the first alignment structure is a laterally extending groove or a laterally extending ridge.

11. The supplemental blade according to claim 9, in which the supplemental blade front surface includes a supplemental blade moldboard defining the supplemental blade first side edge, the supplemental blade further comprising a second alignment structure configured to align in abutting engagement the supplemental blade first side edge with the tractor blade moldboard first side edge.

12. The supplemental blade according to claim 11 wherein the second alignment structure is a laterally extending projection or a laterally facing recess.

13. The supplemental blade according to claim 12 wherein the second alignment structure is a unitary edge lock attached to the supplemental blade back surface and having a portion that extends laterally beyond the supplemental blade first side edge.

14. The supplemental blade according to claim 13 wherein the edge lock portion that extends laterally beyond the supplemental blade first side edge includes integral first and second fingers separated by a recess.

15. A tractor blade assembly, comprising:

a first blade having:

a first blade moldboard having a curved front surface, the first blade moldboard defining an overall vertical height and an overall lateral width extending from a first side edge of the first blade moldboard to a second side edge of the first blade moldboard; a first blade back surface;

a machine mounting bracket disposed on the first blade back surface; and a supplemental blade mounting section extending laterally beyond the first side edge of the first blade moldboard, the supplemental blade mounting section defining a forward facing mounting surface; and a second blade having:

a second blade moldboard defining a first side edge; and a rearward facing mounting surface configured to seatingly engage the forward facing mounting surface of the first blade across a forward facing mounting surface height of at least approximately one-half the overall vertical height of the first blade moldboard and across a forward facing mounting surface width of at least approximately one-quarter the overall lateral width of the first blade moldboard, wherein the rearward facing mounting surface of the second blade is removably attached to the forward facing mounting surface of the first blade such that the first side edge of the second blade moldboard abuts in direct contact the first side edge of the first blade moldboard.

16. The tractor blade assembly according to claim 15 wherein the forward facing mounting surface of the first blade includes a forward facing groove that receives a rearward facing ridge on the rearward facing mounting surface of the second blade to restrict vertical movement of the second blade relative to the first blade.

17. The tractor blade assembly according to claim 15 wherein the first blade includes a laterally facing recess that receives a projection on the second blade to align in abutting engagement the first side edge of the first blade moldboard with the first side edge of the second blade moldboard.

18. The tractor blade assembly according to claim 15 wherein:

the first blade further comprises a second supplemental blade mounting section extending laterally beyond the second side edge of the first blade moldboard, the second supplemental blade mounting section defining a second forward facing mounting; and the assembly further includes a third blade having:

a third blade moldboard defining a first side edge; and a second rearward facing mounting surface configured to seatingly engage the second forward facing mounting surface of the first blade across a second forward facing mounting surface height of at least approximately one-half the overall vertical height of the first blade moldboard and across a second forward facing mounting surface width of at least approximately one-quarter the overall lateral width of the first blade moldboard, the second rearward facing mounting surface of the third blade being removably attached to the second forward facing mounting surface of the first blade such that the first side edge of the third blade moldboard engagingly abuts the first side edge of the first blade moldboard.

19. The tractor blade assembly of claim 15, in which the machine mounting bracket is disposed on the supplemental blade mounting section opposite the forward facing mounting surface.

* * * * *